United States Patent [19]

Fujisaki et al.

[11] 4,263,700

[45] Apr. 28, 1981

[54] METHOD OF PRODUCING A FLUORESCENT DISPLAY TUBE

[75] Inventors: Minolu Fujisaki; Tetsuro Sasaki, both of Mobara, Japan

[73] Assignee: Futaba Denshi Kogyo K.K., Chiba, Japan

[21] Appl. No.: 7,783

[22] Filed: Jan. 30, 1979

[30] Foreign Application Priority Data

Jan. 13, 1978 [JP] Japan ..... 53/8806

[51] Int. Cl.[3] ..... H01J 9/26; H01J 9/32; H01J 9/36

[52] U.S. Cl. ..... 29/25.13; 29/837; 228/180 R; 228/263 R

[58] Field of Search ..... 316/19; 29/25.13, 25.14, 29/25.16, 628, 627; 228/180 A, 180 R, 185, 253, 263

[56] References Cited

U.S. PATENT DOCUMENTS

| | | | |
|---|---|---|---|
| 3,381,372 | 5/1968 | Capano | 29/627 |
| 3,480,836 | 11/1969 | Aronstein | 29/627 X |
| 3,986,760 | 10/1976 | Kishino | 316/19 |
| 4,035,885 | 7/1977 | Matsushita et al. | 427/55 X |

*Primary Examiner*—Richard B. Lazarus

*Attorney, Agent, or Firm*—Oblon, Fisher, Spivak, McClelland & Maier

[57] ABSTRACT

A fluorescent display tube includes in the casing a plurality of anode display portions formed of segment electrodes each having a fluorescent material layer thereon, cathodes and control electrodes disposed opposite to the anode display portions, lead-in wires led out in an air-tight manner from the casing and electrically connected to the segment electrodes, the control electrodes and the cathodes, a plurality of conductive section each connected to the adjacent common segment electrodes through a corresponding conductive wiring film, the lead-in wires for the segment electrode terminal each having at the end thereof in the casing a contact with a spring portion, the contact coming in contact with the corresponding conductive section by the action of the spring portion as well as a conductive adhesive applied thereto thereby establishing an electrical connection.

A method of producing a fluorescent display tube includes forming an anode plate, forming electrode assembly framework, forming a casing using the anode plate, upper cover and the electrode assembly framework by sealing and removing unnecessary parts after sealing.

3 Claims, 3 Drawing Figures

METHOD OF PRODUCING A FLUORESCENT DISPLAY TUBE

BACKGROUND OF THE INVENTION

1. Field of the Invention

The present invention relates to a flat-type fluorescent display tube used in an electronic desk calculator, electronic clock or the like and a method of manufacture thereof.

2. Description of the Prior Art

The fluorescent display tube usually employs fluorescent material which emits light when electrons emitted from the cathode collide therewith, can obtain a very clear green display and therefore is often used in an electronic desk calculator, clock or other various electronic appliances. Such display tubes of various shapes have been commercially marketed.

Recently, in compliance with commercial demand for such a display tube which is smaller in size and capable of indicating multiple digits, thin flat-type display tubes have been developed and widely used. One of the display tube in the conventional type comprises an substrate made of an insulating material such as glass on which anode display portions formed of segment anode groupes with fluorescent material layers are disposed to form an anode substrate, an electrode assembly framework including mesh-shaped control electrodes and filamentous cathodes opposite to the anode display portions on the anode substrate, and a flat box-shaped upper cover having at least a transparent window portion. The anode substrate, electrode assembly framework, and upper cover are laminated one after another, and the peripheral portions of the anode substrate and the upper cover are air-tightly sealed with a sealing medium having a low melting point, such as frit glass to form a highly evacuated casing which makes use of the substrate as a part of the flat casing. In the flat-type fluorescent display tube as explained hereinabove, lead-in wires connected to each electrode are air-tightly led out from the casing through the peripheral sealing portions between the substrate and the upper cover, and the electrical connection between lead-in wires for each of the anodes and the respective anodes has been established in a separate step from the sealing of the casing using a method which melts and burns conductive frit glass to mechanically fix and electrically connect wiring conductors linearly printed on the substrate and connected to the segment anodes to the respective terminating ends of the lead-in wires for the anode which extend inside of the tube. However, in order to adopt the above melting and burning process using the conductive frit glass, a precaution must be taken so as not to deteriorate or adversely influence upon the characteristics of the fluorescent material layers and the cathodes, and sometimes the substrate and various electrodes mounted thereon are damaged or deteriorated by heating and burning, thereby making it difficult to produce sufficiently good and uniform products.

There is recently proposed and put into practical use the other type of fluorescent display tube which eliminates the above-mentioned disadvantages of the prior art. This fluorescent display tube comprises a casing formed of an anode substrate and an upper cover which are sealed at the peripheral portions thereof, a plurality of anode display portions each composed of segment anodes having fluorescent material layers thereon, control electrodes and filamentous cathodes disposed above the anode display portions so as to face the anode display portions, and a plurality of lead-in wires each electrically connected to the respective segment anodes, the control electrodes and the cathodes and air-tightly led out from the casing through the sealing portions between the anode substrate and the upper cover. In this conventional fluorescent display tube, there is provided a plurality of conductive sections on the anode substrate which are connected to the respective segment anodes through conductive wiring film. The lead-in wires for the segment anode extending to the inside of the casing through the seal portion include a contact having a spring portion at each end thereof so as to correspond to the respective conductive sections. The contact is pressed against the conductive section by the action of the spring portion thereby establishing an electrical connection without the use of the conductive frit glass. In the prior art device, the electrical connection between the lead-in wires and the respective segment anodes is made by the press contact using a spring force within a highly evacuated envelope. Therefore, the tube is simple in construction, can be used for a long time without deterioration. In addition, the intermediate heating and burning process at a high temperature which deteriorates the fluorescent material and the cathodes can be eliminated.

The fluorescent display tube of the prior art explained hereinabove can be satisfactorily operated under a certain condition. However, due to the recent expansion of the use of the fluorescent display tube, the fluorescent display tube has now been used in various electronic indicating appliances which are equipped with the inside of a car or the like. In the fluorescent display tube used in the appliances which always undergo strong vibration or shock, it is required to take special precaution for protecting the display tube against the mechanical vibration and shock. Otherwise, the tube would be damaged due to a failure in the electrical connection of contacts within the tube. This is particularly true in the fluorescent display tube in which the electrical connection between lead-in wires for the segment anode and conductive section is made by a pressure contact by the action of the spring.

SUMMARY OF THE INVENTION

Therefore, the present invention contemplates to eliminate the above-mentioned disadvantages of the conventional fluorescent display tube and to provide a new and novel fluorescent display tube and a method of producing the same.

It is an object of the present invention to provide a fluorescent display tube simple in construction, free of deterioration for long time use, durable against vibration and shock, and high in reliability and to provide a method of producing the same.

It is another object of the present invention to provide a fluorescent display tube which enables the yield in the production process to increase and enables the yield to be made uniform and high in quality at low cost.

It is still another object of the present invention to provide a method of producing a fluorescent display tube which is extremely simplified and suitable for mass production and can produce uniform and high quality products at low cost.

It is a further object of the present invention to provide a fluorescent display tube which is very thin and compact.

The foregoing and other objects are attained in accordance with one aspect of the present invention through the provision of a fluorescent display tube which comprises a casing formed of an anode substrate and an upper cover which are sealed at the peripheral portions thereof, anode display portions each composed of a plurality of segment anodes having a fluorescent material layer thereon, control electrodes and cathodes mounted above the respective anode display portions so as to be opposite thereto, a plurality of lead-in wires each electrically connected to the respective segment anodes, the control electrodes and the cathodes and led out from the casing in an air-tight manner through the seal portion between the anode substrate and the upper cover. On the anode substrate, there is provided a plurality of conductive sections which are connected to each of the segment anodes through conductive wiring films. The lead-in wires for the respective segment anodes extending to the inside of the casing through the seal portion include a contact having a spring portion at each end thereof to be connected to each of the conductive sections. The contact is pressed against the conductive section by the action of the spring portion and adhered to the conductive section by a conductive adhesive thereby establishing an electrical connection.

According to another aspect of the present invention, there is provided a method of producing a fluorescent display tube which comprises first stage comprising forming an anode plate by fixedly coating the upper surface of a substrate made of an insulating material with conductive sections and a plurality of conductive wiring films for connecting segment electrodes to respective conductive sections, fixedly coating the upper surface of the substrate with an insulating film adapted to insulate each wiring film and segment electrodes and adapted to connect each conductive section to respective segment electrodes through the wiring film and fixedly coating the upper surface of the insulating film with a plurality of segment electrodes with fluorescent material layers thereon, the segment electrodes constituting anode display portions; a second stage comprising integrally forming a frame, at least a plurality of cathode supports, a plurality of lead-in wires for the cathode terminal connected to the respective cathode supports, a plurality of control electrode supports, a plurality of lead-in wires for the control electrode terminal connected to the respective control electrode supports, and a plurality of lead-in wires each having at the end thereof a contact with a spring portion, fixing a plurality of net-shaped control electrodes to respective control electrode supports, and fixing filament-shaped cathodes to the cathode supports thereby forming an electrode assembly framework; a third stage comprising forming a casing by mounting an upper cover and the electrode assembly framework on the anode plate so that the peripheral portions of the upper cover and the anode plate hold therebetween the respective lead-in wires provided on the electrode assembly framework and so that the contact of each lead-in wire for the segment electrode terminal comes into contact with the corresponding conductive section by the action of the spring portion and hermetically sealing the peripheral portions using a sealing medium; and then removing unnecessary portions of the frame, lead-in wires, etc. outside the casing after sealing. According to the method of manufacturing the fluorescent display tube of the present invention, a conductive adhesive made of frit glass and a conductive material having a softening point substantially equivalent to or little lower than that of the sealing medium used for sealing the casing is applied to either the upper surface of the conductive sections provided on the anode plate or the contacts formed on the electrode assembly framework or both of the conductive sections and the contacts prior to the sealing of the upper cover and the anode substrate. Then, the conductive adhesive is heated so that it may be melted and deposited on either the conductive sections or the contacts or both of these section. In the subsequent sealing step for forming the casing, the contacts are welded to the conductive section by the adhesive softened by the application of heat for the sealing operation of the casing under the condition of being pressed against the conductive sections by the spring portion.

BRIEF DESCRIPTION OF THE DRAWINGS

Other objects, features and advantages of the present invention will be more apparent from the following description with reference to the accompanying drawings in which like reference numerals and characters designates corresponding parts throughout the views and in which.

DETAILED DESCRIPTION OF THE PREFERRED EMBODIMENTS

Figure 1:
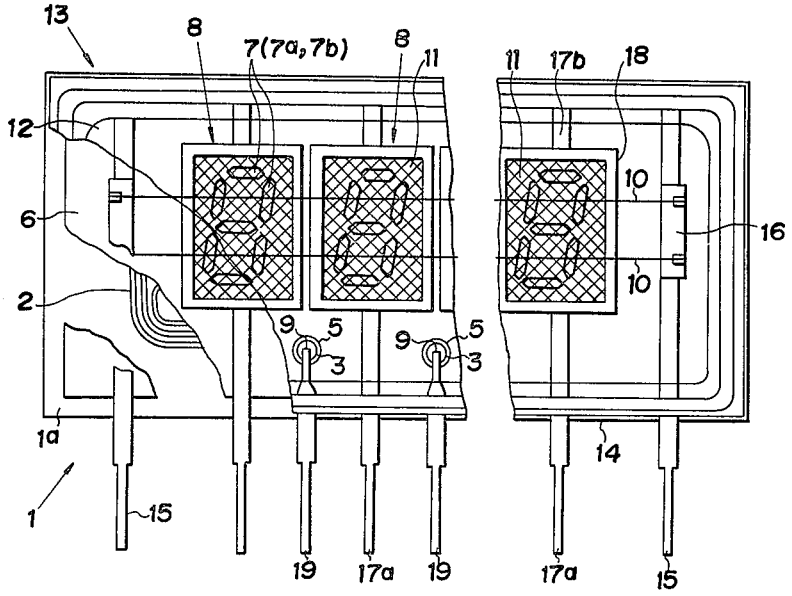
FIG. 1 is a partially cutaway plan view of the essential part of a fluorescent display tube according to the present invention, showing an example thereof.
Figure 2:
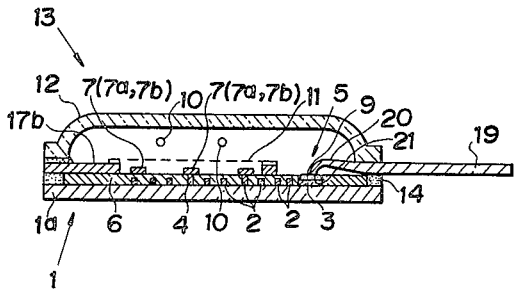
FIG. 2 is a sectional end view of FIG. 2.

Now, the present invention will be hereinafter described in detail with reference to FIGS. 1, 2, and 3. FIG. 1 is a partially cutaway plan view of the essential part of a fluorescent display tube according to the present invention, and FIG. 2 is a sectional view thereof.

In the drawings, numeral 1 generally designates an anode plate which is formed in a laminated state. The anode plate 1 includes a substrate 1*a* made of an insulating material such as glass and ceramics, a plurality of wiring conductors 2 coated on the substrate 1*a* which are made of a conductive material and include conductive sections 3 at each terminating end of the wiring conductors 2, an insulating film 6 coated on the wiring conductors 2 and the conductive sections 3 which includes through-holes 4 and openings 5 at the predetermined positions of the insulating film 6, a plurality of segment electrodes 7 coated on the insulating film 6 and deposited a fluorescent material layer 7*a* on each of the segment electrodes 7 to form a plurality of anode display portion 8. Each of the segment electrodes 7 for forming each anode display portion 8 comprises anode conductors 7*b* on which the fluorescent material layer 7*a* is deposited and electrically connected to the respective wiring conductors 2 through the holes 4 provided on the insulating film 6.

The openings 5 of the insulating film 6 are positioned above each of the conductive sections 3 on which conductive adhesive 9 such as for example, conductive metal powders and frit glass, are deposited so that lead-in wires for applying a drive signal to each of the segment anodes 7 from the outside may be connected to the conductive sections 3 by burning the conductive adhesive 9.

Numeral 10 designates one or more filamentous cathodes emitting thermions when electrically heated, and the cathodes are disposed opposite to and above the anode display portions 8. A plurality of control electrodes 11, each formed of mesh, are disposed opposite to each of the anode display portions 8 between the cathodes 10 and the respective anode display portions 8 to accelerate and control thermions emitted from the cathodes 10 to each of the anode display portions 8. Numeral 12 designates a flat box-shaped upper cover having a transparent peep window made of glass at a portion thereof opposite to the anode display portions 8. The upper cover 12 is hermetically sealed to the anode substrate 1 at the peripheral portion thereof using a sealing medium such as low melting point frit glass to form a casing 13.

The cathodes 10 are supported on cathode supports 16 to form a cathode terminal connected to cathode terminal lead-in wires 15 which are extended in air-tight manner through the sealed portion 14 between the substrate 1 and the upper cover 12. The control electrodes 11 are supported on a plurality of control electrode supports 18 to form a supporting strip 17*b* and a control electrode terminal connected to a plurality of lead-in wires 17*a* extended in an air-tight manner through the sealed portion 14, respectively.

A plurality of lead-in wires 19 for a segment anode are extended in an air tight manner through the sealed portion 14. The portion of each lead-in wire 19 inside the sealed portion 14 has a contact 21 provided through a spring portion 20. The contact 21 is pressed against each conductive section 3 connected to each segment electrode 7 through the wiring conductor 2 by the action of the spring portion 20 and adhered thereto by the adhesive 9 deposited on each conductive section 3 to thereby establish an electrical connection.

The conductive adhesive 9 deposited on the conductive section 3 for sticking the content 21 is made of conductive frit glass having a softening point substantially equivalent to or little lower than that of the sealing medium used for sealing the peripheral portion 14 between the anode substrate 1 and the upper cover 12. The adhesive 9 is applied to either the upper surface of the conductive section 3 provided on the anode substrate 1 or the contact 21 of the lead-in wire 19 or both of the conductive section 3 and the contact 21, and subjected to be heated so that the adhesive may be melted and deposited on these portions prior to the sealing of the anode substrate 1 and the upper cover 12. According to this steps, volatile materials contained in the conductive adhesive, such as a binder, are satisfactorily evaporated and removed from the adhesive before sealing the upper cover 12 to the anode substrate 1, and also the adhesive is softened by heat when the upper cover 12 is sealed to the anode substrate 1, which enables to adhere the contact 21 to each of the conductive sections 3 firmly and effectively.

The spring portion 20 provided on the lead-in wire 19 for the segment anode extending to the inside of the sealed portion 14 may be formed to have at least such a spring force that the contact 21 at the end of the spring portion 20 can be lightly pressed against the adhesive agent 9 on the conductive section 3 to be contacted thereto when the casing 13 is formed by sealing. The spring portion 20 may be formed to utilize the resilient force of the lead-in wire 19, or may be formed of a suitable resilient material such as stainless steel plate and Fe-Ni alloy plate which is connected to the lead-in wire 19 by spot welding or the like.

As is apparent from the above-mentioned example, the fluorescent display tube according to the present invention is extremely easy to use, because the lead-in wire connected to each of the electrodes is extended directly through the sealed portion between the anode substrate and the upper cover of the casing. Furthermore, an electrical connection between a plurality of segment electrodes and each lead-in wire therefor is made by using a very simple and reliable construction in which the contact pressed by the spring is brazed by the conductive adhesive in the vacuum casing. Therefore, the fluorescent display tube according to the present invention is durable against vibration and shock and stable performance free of deterioration for a long time can be realized. If such a tube is produced according to the following method, additional excellent effects will be obtained.

Now the method of producing a fluorescent display tube according to the present invention will be hereinafter described in detail in conjunction with FIG. 3.

Figure 3:
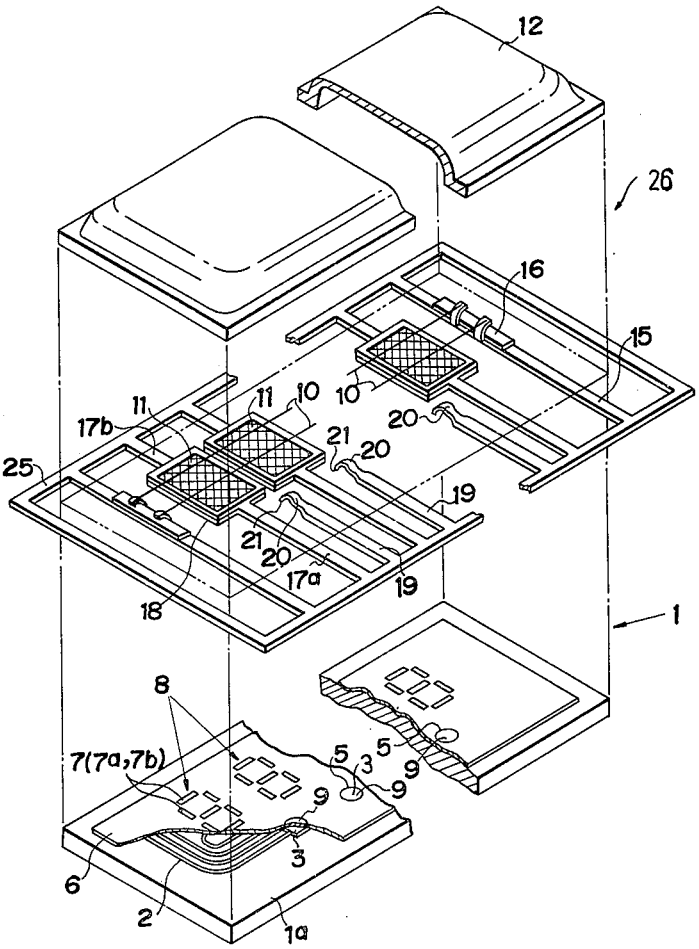
FIG. 3 is an exploded perspective view of a fluorescent display tube according to the present invention, showing an example of producing the same.

FIG. 3 is a perspected exploded view of the essential part of a fluorescent display tube of the present invention, showing the method of producing the same.

In a first stage of assembling the fluorescent display tube according to the present invention, a plurality of wiring conductors 2 having conductive sections 3 at the respective terminating ends thereof are formed on the upper surface of a substrate 1*a* made of an insulating material such as glass and ceramics by a screen printing, and fixedly deposited on the surface of the substrate by heating. The wiring conductors 2 are made of a conductive material and connect each common segment anode 7 of adjacent display portions 8, and the conductive sections 3 of the respective wiring conductors 2 are electrically connected to lead-in wires 19 which are led out from a casing. The upper surface of the substrate 1*a* on which each of the wiring conductors 2 and the conductive sections 3 are arranged is coated with an insulating film 6 having through-holes 4 to register any one of the wiring conductors 2 and openings 5 to register the respective conductive sections 3. The insulating film 6 is applied to the upper surface of the substrate by, such as for example, a screen printing and firmly deposited on the surface of the substrate by burning. On the upper surface of the insulating film 6, anode conductors 7*b* of the segment anodes 7 for for forming each of the anode display portions 8 are disposed in the shape of the digit 8 as shown in the drawing so that each anode conductors 7*b* may be electrically connected to the corresponding wiring conductors 2 through the connecting holes 4 provided on the insulating film 6. The anode conductors 7*b* are made of a conductive material which is applied to the surface of the insulating film 6 by a screeen printing and fixedly deposited on the surface of the insulating film 6 by calcination. Then, a fluorescent material layers 7*a* are deposited on the upper surface of the respective anode conductors 7*b* by a screen printing, electric deposition, precipitation or the like thereby to form each of the segment anodes 7 constituting the respective anode display portion 8.

In a second stage of assembling the fluorescent display tube according to the present invention, an electrode assembly framework 26 is prepared. The electrode assembly framework 26 includes a frame 25, at least a plurality of lead-in wires 15 for a cathode terminal, a plurality of cathode supports 16 connected to the lead-in wires 15 for the cathode terminal, a plurality of control electrode supports 18 connected to lead-in wires 17*a* for a control electrode terminal and to supporting strips 17*b* for the control electrode support 18, and a plurality of lead-in wires 19 for a segment anode each having at the end thereof a contact 21 with a spring portion 20. The electrode assembly framework 26 is integrally formed with the use of a metal by a photo-etching technique. Then, a plurality of mesh-shaped control electrodes 11 are fixed to the respective control electrode supports 18, and filamentous cathodes 10 coated with a material high in electron emissivity are fixed to the cathode supports 16. In addition, auxiliary parts such as a getter (not shown) are provided at any suitable location of the electrode assembly framework 26.

In a third stage of assembling the fluorescent display tube according to the present invention, the electrode assembly framework 26 is mounted on the anode substrate 1 so that each opposing anode display portion 8 and the control electrode 11 may be mated and so that the contact 21 of each lead-in wire 19 for the segment electrode terminal comes into contact with the corresponding conductive section 3 by the action of the spring portion 20. Then, a box-shaped upper cover 12 having a transparent peep window made of a material such as glass at least on the upper surface thereof is mounted on the electrode assembly framework 26 so that the peripheral portions of the upper cover 12 and the anode substrate 1 hold therebetween the respective lead-in wires 15, 17*a*, and 19 and the supporting strips 17*b* provided on the electrode assembly framework 43, and the above peripheral portions are air-tightly sealed with the use of a sealing medium 14 such as a low melting point frit glass, and subjected to be heated to have the sealing medium calcined to unite the upper cover 12 and the anode substrate 1 together to form a casing.

After the above-mentioned third stage for forming the casing by sealing, unnecessary portions of the frame 25, lead-in-wires, supporting strips which extend outside the casing are removed. The fluorescent display tube assembled in this matter is subjected to evacuation, aging, getter flushing, and the like as in the conventional process.

The method of producing the fluorescent display tube according to the present invention resides in an improvement in the above-mentioned second and third stages. In the present invention, a conductive adhesive 9, such as for example, a conductive frit glass having a softening point substantially equivalent to or little lower than that of the sealing medium 14 such as a low melting point frit glass used for sealing the envelope 13 is applied to either the upper surface of the conductive sections 3 provided on the anode structure 1 or the contact 21 formed on the electrode assembly framework 26 pressed against the conductive section 3 by a spring force or both of the conductive sections 3 and the contact 21. The conductive adhesive is heated to evaporate volatile materials contained in the conductive adhesive such as a binder so that the adhesive may be melted and deposited on either the conductive sections 3 or the contacts 21 or both of these sections as a bead. In the subsequent sealing step, the conductive adhesive 9 is softened by application of heat for sealing the peripheral portions between the upper cover 12 and the anode substrate 1 to form the envelope 13, which enables to braze the conductive sections 3 and the contacts 21 and ensures the reliable connection of the conductive sections 3 and the contact 21.

In the step of forming the electrode assembly framework 26 for manufacturing the fluorescent display tube according to the present invention, the electrode assembly framework 26 may be integrally formed so as to have a frame 25, at least cathode supports 16, lead-in wires 15 for a cathode terminal, control electrode supports 18, lead-in wires 17*a* for a control electrode terminal, and lead-in wires 19 for the respective segment anodes each having a contact 21 with a spring portion 20. Then, the control electrodes 11 are fixed to the respective control electrode supports 18 thereby to form an intermediate assembly framework. The intermediate assembly framework is disposed on the anode substrate 1 so that each opposing anode display portion 8 and the control electrodes 11 may be mated and so that the contact 21 of each lead-in wire 19 for the segment electrode terminal comes into contact with the adhesive deposited on the corresponding conductive section 3 by the action of the spring portion 20. The intermediate assembly framework is then temporarily fixed to the anode substrate 1 by applying a suitable adhesive such as glass frit not yet burned to suitable portions of the intermediate assembly framework, and the cathodes 10 are fixed to the intermediate assembly framework thereby forming an electrode assembly framework 43. In this case, an upper cover 2 is placed on the anode substrate 1 on the upper surface of which the assembly framework is temporarily fixed, and is hermetically sealed to form a casing.

In the above-mentioned embodiment of the present invention, the substrate 1 on which the anode display portions are disposed is shown as flat, and the upper cover 12 is shown as flat-bottomed boat-shaped. However, it is not necessary to limit the substrate 1 and the upper cover 12 to the above shapes. For instance, both the substrate 1 and the upper cover 12 may be formed flat and a suitable spacer may be placed therebetween; or only the substrate 1 may be formed into a flat-bottomed boat shape; or both the substrate 21 and the upper cover 32 may be formed into a flat-bottomed boat shape; or any other combinations of suitable shapes are possible.

In the above-mentioned embodiment of the present invention, provision of a getter in the casing was not specifically mentioned. However, it goes without saying that a getter can be disposed at a suitable position in the casing. In the fluorescent display tube according to the present invention, a frame 25 adapted to be equipped with a getter may be used to form an electrode assembly framework provided with a getter. Thus, the provision of a getter in the casing may be quite reasonably effected.

In the above-mentioned embodiment of the present invention, the provision of a usually used exhaust pipe was not specifically mentioned. However, a usually used exhaust pipe may be held at a desired position of the sealing portion to be fixed in the sealing process; or may be previously fixed at a desired position of the substrate 21 or the upper cover 32 using a suitable sealing medium. Sealing between the anode plate 41 and the upper cover 32 may be effected in a high vacuum without an exhaust pipe simultaneously with the air evacuation.

In the above-mentioned embodiment of the present invention, there was shown a plurality of the anode display portions each composed of a plurality of the segment anodes in the shape of the figure 8 and arranged in side-by-side relationship. However, it is not necessary to limit the anode display portions to the above shape. For instance, the anode display portion may be formed of segment anodes arranged in the shape of a dot matrix or bar, or may be formed to represent a single letter, numeral, symbol or the like.

As is apparent from the foregoing description, the fluorescent display tube according to the present invention has the above-mentioned construction and is produced by the above-mentioned construction and is produced by the above-mentioned method and therefore has the following various features and effects:

(1) The electrical connection between each segment anode and lead-in wire is made by pressure contact therebetween by the action of spring force as well as brazing by the conductive adhesive so that the contact provided at the inside of the lead-in wire which is sealed and held at the sealing portion of the casing and extends to the inside of the highly evacuated casing may be connected to the conductive section 3 provided on the anode substrate and connected to each segment anode by means of the wiring conductor. Therefore the tube in simple in construction and stable against vibration and shock, because the perfect electrical and mechanical connection between the lead-in wires and the respective conductive section can be achieved with the use of a small amount of the conductive adhesive. Furthermore, the tube according to the present invention can be used for a long time without deterioration and applicable to indicators used in various apparatuses which undergo vibration and shock, such as a car, train, air craft and the like.

(2) According to the present invention, the lead-in wires connected to the respective segment anodes, each control electrode, the lead-in wires for each control electrode, the cathode holder, and the lead-in wires for cathodes are fixed to the tube in such a manner that each of the lead-in wires connected to the respective electrodes is air-tightly held at the sealing portions between the anode substrate and the upper cover and extended to the outside of the tube. Thus, it is not necessary to adopt an intermediate process including high temperature heating and burning which is conventionally carried out when the connection is made using an adhesive such as conductive frit glass and which deteriorates the fluorescent material and the electron emitting coating material on the cathode due to the emission of noxious gases. Therefore, the yield of the production process is improved, and fluorescent display tubes uniform and high in quality can be produced at low cost.

(3) The method of producing the fluorescent tube according to the present invention consists of the steps of producing an anode plate utilizing the printing technique; making an electrode assembly framework by integrally forming control electrodes, cathodes and various lead-in wires; and forming a casing by sealing the anode plate, electrode assembly framework and upper cover together. Compared with the conventional method, this method is very much simplified and is suitable for mass-production. Therefore, this method can produce uniform and high quality products at low cost.

(4) The fluorescent display tube according to the present invention has a construction in which lead-in wires also used as terminals are directly led out from the casing through the seal portions thereof and in which unnecessary space in the casing is minimized due to the anode display portions being provided directly on the substrate which forms a part of the casing. Therefore, the casing can be made very thin and compact in its entirety. Furthermore, the lead-in wires led out from the casing through the seal portions thereof can be used as a terminal to be connected to electronic appliances as they are. Therefore, the fluorescent display tube according to the present invention eliminates necessity of an additional connector and is advantageous with respect to a cost and handling.

Obviously, numerous modifications and variations of the present invention is possible in light of the above teachings. It is therefore to be understood that within the scope of the appended claims the invention may be practiced otherwise than as specifically described therein.

What is claimed as new and desired to be secured by Letters Patent of the United States is:

1. A method of producing a fluorescent display tube comprising:

forming an anode plate by fixedly coating the upper surface of a substrate with a plurality of conductive wiring films having at the end thereof conductive portions to be connected to segment electrodes through the plurality of conductive wiring films, fixedly coating the upper surface of the substrate with an insulating film having through holes registering with each conductive portion and portions for connecting each of the wiring films to corresponding segment electrodes, and fixedly coating the upper surface of the insulating film with a plurality of segment electrodes to be connected to each of the corresponding wiring films through the through holes and deposited fluorescent material layers thereon, the segment electrodes constituting anode display portions;

forming a framework by integrally forming at least a frame; a plurality of cathode supports, a plurality of cathode terminal lead-in wires connected to respective cathode supports, a plurality of control electrode supports, a plurality of control electrode terminal lead-in wires connected to respective control electrode supports, and a plurality of segment electrode terminal lead-in wires each having at the end thereof a contact with a spring portion;

forming an electrode assembly framework by fixing a plurality of control electrodes to respective control electrode supports and fixing cathodes to the cathode supports;

applying a conductive adhesive made of frit glass and conductive materials to either the upper surface of each conductive portion or the contact of each spring loaded lead-in wire for the segment anode provided at the electrode assembly framework or both of these portions, and heating the conductive adhesive to be melted and deposited thereon;

forming a casing by mounting the electrode assembly framework and an upper cover on the anode plate so that each of the lead-in wires provided on the electrode assembly framework extends from the casing and so that the contact of each spring loaded lead-in wire for the segment electrode terminal is spring biased into contact with the corresponding conductive portion by the action of the spring portion thereof and hermetically sealing the peripheral portions of the upper cover to the anode plate using a sealing medium made of a frit glass having a softening point substantially equal to that of the conductive adhesive applied to the connecting portions of the lead-in wires and the corresponding conductive portions and heating the casing, thereby softening the conductive adhesive and adhering the spring loaded contact of each lead-in wire for the segment electrode terminal to the corresponding conductive portion concurrently with calcination of the sealing medium for effecting the hermetical seal between the upper cover and the anode plate;

removing portions of the frame and lead-in wires extending outside the casing after sealing so as to separate each of the lead-in wires for making individual contact to the respective electrodes within the fluorescent display tube.

2. A method of producing a fluorescent display tube as in claim 1 wherein the conductive adhesive has a softening point a little lower than that of the sealing medium.

3. A method of producing a fluorescent display tube as in claim 2 wherein the filamentous cathodes are fixed to the cathode supports after mounting the electrode assembly framework on the anode plate.

* * * * *